US006732821B2

(12) United States Patent
Boulet

(10) Patent No.: US 6,732,821 B2
(45) Date of Patent: May 11, 2004

(54) PROFILED ELEMENT FOR ROTARY DRILLING EQUIPMENT AND APPLICATIONS TO COMPONENTS OF A STRING OF DRILL PIPES

(75) Inventor: Jean Gilbert Boulet, Paris (FR)

(73) Assignee: S.M.F. International, Cosne sur Loire (FR)

( * ) Notice: Subject to any disclaimer, the term of this patent is extended or adjusted under 35 U.S.C. 154(b) by 0 days.

(21) Appl. No.: 10/155,242

(22) Filed: May 28, 2002

(65) Prior Publication Data

US 2003/0221872 A1 Dec. 4, 2003

(51) Int. Cl.[7] ..... E21B 17/12
(52) U.S. Cl. ..... 175/323; 175/325.1
(58) Field of Search ..... 175/323, 325, 175/325.2, 325.5, 325.6, 325.7

(56) References Cited

U.S. PATENT DOCUMENTS

| | | | | |
|---|---|---|---|---|
| 1,848,128 A | | 3/1932 | Hinderliter | |
| 4,664,206 A | | 5/1987 | Butler | |
| 5,040,620 A | | 8/1991 | Nunley | |
| 5,174,391 A | | 12/1992 | Zijsling | |
| 6,056,073 A | * | 5/2000 | Boulet | 175/323 |
| 6,152,220 A | | 11/2000 | Carmichael | |
| 6,167,917 B1 | | 1/2001 | Scott Aitken | |
| 6,202,769 B1 | | 3/2001 | Ikegaya et al. | |
| 6,223,840 B1 | | 5/2001 | Swietlik | |

FOREIGN PATENT DOCUMENTS

| | | |
|---|---|---|
| EP | 254 900 A2 | 2/1998 |
| EP | 0 866 209 A1 | 9/1998 |
| EP | 1 026 364 A1 | 8/2000 |
| WO | WO 99/05391 | 2/1999 |

* cited by examiner

*Primary Examiner*—William Neuder
(74) *Attorney, Agent, or Firm*—Sughrue Mion, PLLC

(57) ABSTRACT

A profiled element for rotary drilling equipment and applications to components of a string of drill pipes has an area of abutment on the wall of a drilling hole having a maximum diameter constituting the maximum diameter of the rotary drilling equipment and a turbulence area for producing an activation of the circulation of a drilling fluid in the annulus. The profiled element also has a deflection area adjacent to the abutment area and to the turbulence area, having at least one surface inclined with respect to the axis of the rotary drilling, whose meridian line moves away from the axis in the direction going from bottom to top, in the service position of the profiled element in the drilling hole.

20 Claims, 11 Drawing Sheets

PROFILED ELEMENT FOR ROTARY DRILLING EQUIPMENT AND APPLICATIONS TO COMPONENTS OF A STRING OF DRILL PIPES

BACKGROUND OF THE INVENTION

The invention concerns a profiled element for rotary drilling equipment, such as a drill stem or collar, interposed in a rotary drill pipe string.

In the field of prospecting and the exploitation of oil deposits, rotary drill pipe strings are used consisting of pipes and possibly other tubular elements connected end to end, according to the drilling requirements.

Such strings can in particular make it possible to produce deviating drillings, that is to say drillings where it is possible to vary the inclination with respect to the vertical or the direction in azimuth, during the drilling. In the case of greatly deviating drillings having practically horizontal portions, the friction torques due to the rotation of the drilling lining may attain very high values during the drilling. The friction torques may call into question the equipment used or the drilling objectives. In addition, it is often very difficult to bring up the cuttings produced by the drilling, because of the sedimentation of the debris produced in the drilling hole, in particular in the part of the drilling hole which is highly inclined with respect to the vertical. The result is poor cleaning of the hole and an increase both in the coefficients of friction of the pipes in the string inside the drilling hole and the contact surfaces between the pipes and the walls of the hole.

DESCRIPTION OF THE PRIOR ART

In order to reduce the coefficient of friction and the contact surface between the string and the walls of the drilling hole and to improve the cleaning of the drilling hole and the discharge of debris in the drilling fluid, there was proposed, in patent application FR-97 03207, a profile for a drill pipe which has a diameter greater than the diameter of the end portions coming into contact with the wall of the drilling hole and provides a certain degree of reduction in the friction between the drill pipe and the wall of the drilling hole. The end parts, which have hydraulic profiles, activate the circulation of the drilling fluid and detach the debris attached to the wall of the drilling hole and form turbulence areas.

In a more recent French patent application, FR-99 01391, a profiled element has been proposed for rotary drilling equipment making it possible to reduce the friction between the drilling equipment and a wall of the drilling hole at the abutment areas of the profiled element and to limit the risks of jamming of the drilling equipment, when the equipment is brought up inside the drilling hole.

To achieve this aim, there are provided, on the profiled element, hollow parts and radially projecting parts having an arrangement in a helix around the profiled element and having geometric and dimensional characteristics which vary according to the axial direction of the element. Preferably, the hollow parts or grooves in the profiled element disposed in helixes have a cross-section of transverse passage, in a plane perpendicular to the axis of the drilling equipment, which decreases in the axial direction and in the direction of circulation of a drilling fluid in a drilling annulus between the equipment and the drilling hole.

In this way, a circulation of drilling fluid is achieved in the circumferential direction around the abutment areas of the profiled element, which reduces the friction between the drill pipe and the wall of the drilling hole at the abutment areas.

The profiled element described in FR-99 01391 generally has, upstream of the abutment area, an area of activation of the circulation of drilling fluid in the annulus of the drilling hole or turbulence area, according to which the profiled element has helical grooves having a profile making it possible to clean the drilling hole and to drive the debris conveyed by the drilling fluid. In general terms, the grooves provided in the different areas of the profiled element are placed in line with each other, along the entire length of the profiled element. However, the drilling debris driven with the drilling fluid may have a tendency to collect at the profiled element, inside the grooves, and effective scavenging of the drilling hole is not always obtained because of an activated axial circulation essentially in contact with the profiled drilling element.

SUMMARY OF THE INVENTION

The aim of the invention is therefore to propose a profiled element for rotary drilling equipment for producing a drilling hole, having an overall shape of revolution and an axis directed along the rotation axis of the drilling and at least one area of abutment on the wall of the drilling hole extending in the axial direction of the profiled element and having a maximum diameter constituting the maximum diameter of the drilling equipment and a turbulence area for producing an activation of the circulation of a drilling fluid in the drilling hole around the drilling equipment, this profiled element making it possible to obtain a good circulation of the drilling fluid in the drilling hole, at the periphery of the drilling equipment, and effective scavenging of the wall of the drilling hole and an energetic entrainment of the drilling debris, in the direction of circulation of the drilling fluid.

For this purpose, the profiled element according to the invention has in addition a deflection area adjacent to the abutment area and to the turbulence area, extending in the axial direction of the profiled element having at least one surface inclined with respect to the axis of the drilling, whose meridian line, in an axial plane, moves away from the axis of the profiled element in the direction going from bottom to top, in the service position of the profiled element in the drilling hole.

BRIEF DESCRIPTION OF THE DRAWINGS

In order to give a good understanding of the invention, a description will be given, by way of example, referring to the accompanying figures, of several embodiments of a profiled element according to the invention and the integration of profiled elements according to the invention in drilling equipment of the conventional type.

DESCRIPTION OF THE PREFERRED EMBODIMENTS

Figure 1:
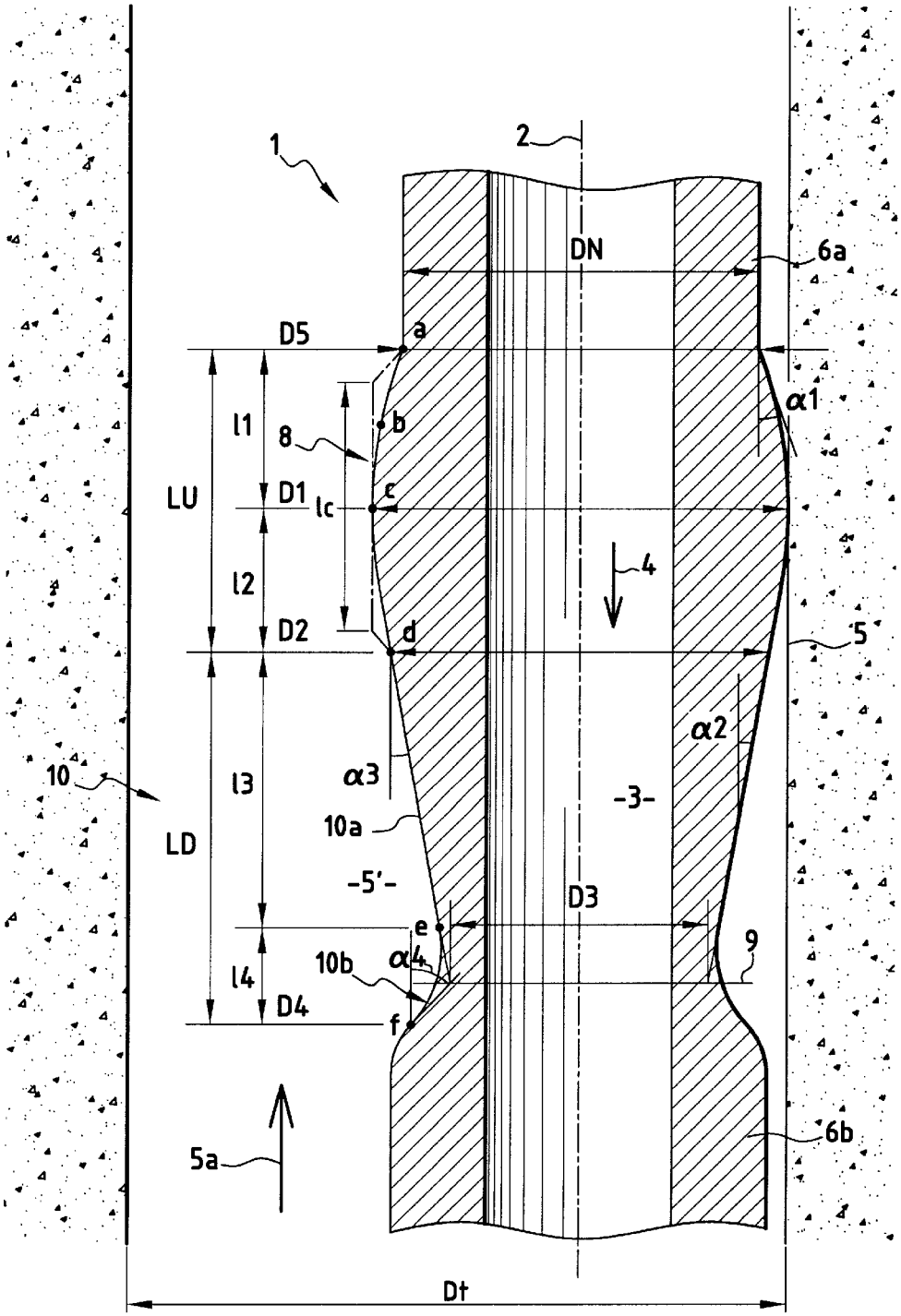
FIG. 1 is a view in axial section of a profiled element according to the invention and according to a first embodiment constituting a portion of rotary drilling equipment.

FIG. 1 depicts a profiled element according to the invention and according to a first embodiment.

The profiled element, designated in general terms by the reference 1, has a general shape of revolution about an axis 2 which constitutes the drilling axis, when the profiled element 1 constituting at least part of a component of a string of drill pipes is in the service position in a drilling hole 5 of diameter Dt, produced by a tool such as a bit disposed at the end of the string of drill pipes. The axis 2 is the axis of rotation of the pipe string.

The profiled element 1 has a tubular shape, a channel 3 with a substantially cylindrical shape being provided at the central part of the profiled element 1.

The different components of the string of drill pipes (such as pipe, collar and tool joint) are all produced in tubular form and are connected together end to end, so that their central channels such as 3 are in line with each other and constitute a continuous central space for the circulation of a drilling fluid, from top to bottom, as depicted by the arrow 4, between the surface from which the drilling is carried out as far as the bottom of the drilling hole where the tool is working.

The drilling fluid or drilling mud then rises up again in an annular space 5' delimited between the wall of the drilling hole 5 and the external surface of the pipe string, as depicted by the arrow 5*a*.

The drilling fluid drives debris from the geological formations through which the drilling tool passes to the surface from which the drilling is being carried out.

The string of drill pipes must be designed so as to facilitate the upward circulation of the drilling fluid in the annulus 5', so as to drive the drilling debris effectively and so as to produce a scavenging of the wall of the drilling hole 5 and the abutment surfaces of the pipe string so as to facilitate the progress of the drill pipe string inside the drilling hole.

The profiled element according to the invention has two substantially cylindrical end parts 6*a* and 6*b* having the same external diameter, which may correspond to the nominal diameter $D_N$ of the drilling equipment on which the profiled element 1 is interposed.

Between the end parts 6*a* and 6*b*, the profiled element 1 has successively an area 8 bearing on the wall of the drilling hole 5 and a profiled area 10 having a deflection area 10*a* and a turbulence area 10*b* produced according to the invention, as will be described below.

In the bearing area 8, the profiled element has a meridian line, that is to say a generator line of the external surface of the bearing area having generally the shape of a straight line or an arc of a circle, so that the external surface of the bearing area has a cylindrical shape or the shape of a spherical sector or a portion of a torus.

In the bearing area, the profiled element has an area with a maximum diameter $D_1$ on which the profiled element comes into abutment on the wall of the drilling hole 5. The diameter $D_1$ constitutes the maximum diameter of the drilling equipment.

The dotted lines in FIG. 1 depict the contour of a cylindrical bearing area of diameter $D_1$ and length $l_c$ which can be substituted for the spherical or toric area depicted in solid lines.

The deflection area 10*a* has a meridian consisting of a line inclined with respect to the axis 2 of the profiled element, so that this meridian line moves away from the axis 2 in the direction from bottom to top, that is to say from the turbulence area 10*b* towards the bearing area 8.

The deflection area 10*a* can be of frustoconical shape, the meridian line then being a straight line.

The turbulence area 10*b* can have a meridian line of curved shape, for example consisting of two arcs of a circle providing a progressive connection of the turbulence area 10*b* to the end area 6*b* and to the deflection area 10*a* of frustoconical shape.

The turbulence area 10*b* has a concave external surface and a part narrowing along the cross-sectional plane 9, whose diameter is generally less than the nominal diameter $D_N$ of the drilling equipment.

The extension of the generatrices of the deflection area 10*a* intersects the plane 9 on a circular area of diameter $D_3$ which defines the maximum narrowing of the section between the bearing area 8 and the bottom connection area 6*b*.

In general terms, the profiled element 1 has an outside diameter less than that the diameter $D_N$ on the turbulence area 10*b* and a part of the deflection area 10*a*, the top end of the deflection area 10*a* then being connected to the bearing area 8 on a section having a diameter greater than the nominal diameter $D_N$.

$D_2$ designates the diameter of the profiled element in the plane of connection between the bearing area 8 and the deflection area 10*a*.

$D_4$ designates the diameter of the profiled element in the plane of connection of the turbulence area 10*b* with the bottom connection part 6*b* and $D_5$ designates the diameter of the profiled element in the plane of connection of the bearing area 8 and the top connection part 6*a*.

$L_D$ designates the length in the axial direction of the deflection area 10 and $L_U$ the total length, in the axial direction, of the bearing area 8.

$l_1$ and $l_2$ designate the lengths in the axial direction of the two parts of the bearing area on each side of the bearing plane on which the diameter of the element 1 is at a maximum, $l_3$ the axial distance between the plane of connection of the deflection area 10*a* and the bearing area 8 and the maximum narrowing plane 9 of the profiled element. $l_4$ designates the length, in the axial direction, of the turbulence area 10*b* situated under the plane 9.

Several points a, b, c, d, e and f have been entered on the meridian line of the profiled elements between the top and bottom connection elements 6*a* and 6*b*.

The parts ab, bc, cd, de, ef of the meridian and its extensions can have curved or straight shapes, so as to facilitate the machining of the profiled element.

The inclination of the various parts of the meridian line with respect to the axial direction 2 is defined by the angles $\alpha_1$, $\alpha_2$, $\alpha_3$ and $\alpha_4$.

In general terms, the geometric shape and the dimensions of the profiled element can be defined by the inequalities and the information given below:

| | |
|---|---|
| $D_N \rightarrow$ Nominal dimension of equipment | |
| $l_1 \geqq l_2$ | $D_1 > D_N \geqq D_3$ |
| $\alpha_1 \geqq \alpha_2$ | $D_2 = D_N \# D_4$ |
| $\alpha_2 \# \alpha_3$ | $D_5 \# D_N$ |
| $\alpha_4 >> \alpha_3$ | |
| $l_3 >> l_4$ | $D_1 \rightarrow$ max Ø of the profile |
| | $D_3 \rightarrow$ min Ø of the profile |
| Preferably: | |
| $\alpha_4 \leqq 45°$ | |
| $\alpha_3 \leqq 30°$ | |
| (abcdef) → "rectilinear" or "curvilinear". | |

In particular, one of the important conditions for producing the profiled element according to the invention and according to the first embodiment is that the angle $\alpha_4$ between the tangent to the meridian of the profile and the direction axial to the bottom part of the turbulence area 10*b* is very much greater than the angle $\alpha_3$ between the tangent to the meridian of the profile and the axial direction of the top part of the deflection area 10*a*, at the point where it is connected to the bearing area 8.

In addition, in the bearing area 8, it is possible to machine grooves which are hollow with respect to the surface of the bearing area, so as to facilitate the continuous passage of the drilling fluid inside the annulus 5', as shown by the arrow 5*a*.

As will be explained with regard to FIG. 2, the shape of the profiled element 1 according to the invention facilitates the circulation of the debris and the cleaning of the hole during drilling, the profiled element being in abutment against the wall of the drilling hole 5 on the largest-diameter part of the bearing area 8 (which may have an anti-wear lining).

Figure 2:
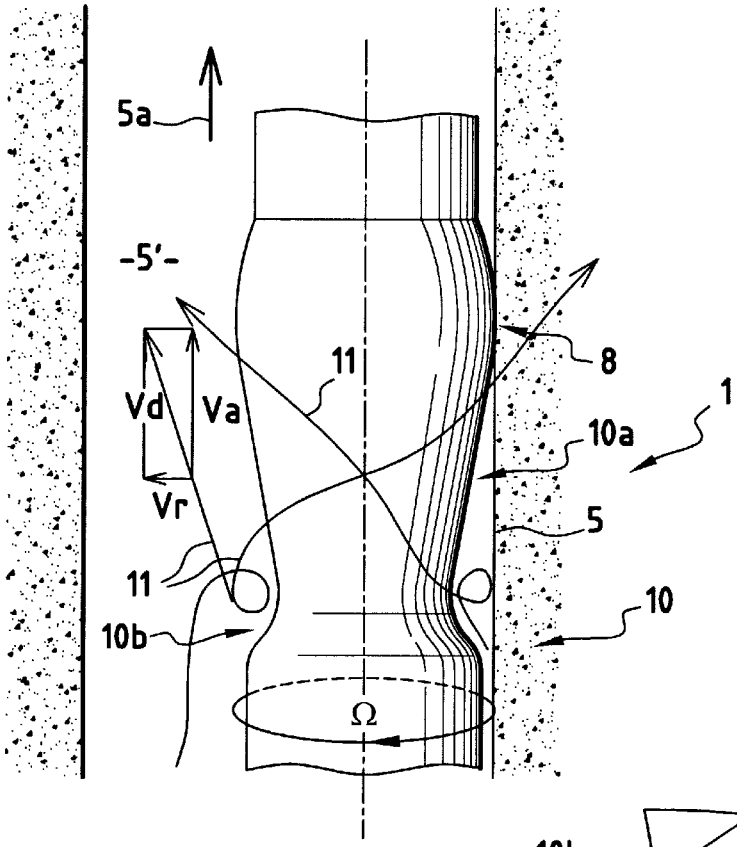
FIG. 2 is an elevation view of the profiled element depicted in FIG. 1 showing the hydraulic effects of this profiled element during drilling.

The drilling fluid circulating from bottom to top in the annulus 5', as indicated by the arrow 5*a*, and transporting drilling debris coming from the bottom of the hole 5, is driven, because of the rotation of the element 1, on a helical path 11 depicted in FIG. 2.

Inside the space delimited by the concave external surface of the turbulence area 10*b* which constitutes a shoulder, the flow 11 creates a vortex which assists the stirring of the drilling fluid and the entrainment of the drilling debris. At the turbulence area 10*b*, the drilling equipment can have, in some cases, a minimal diameter. The drilling fluid and the debris next encounter the inwardly inclined wall of the deflection area 10*a*, so that the drilling fluid and the debris are directed towards the internal contour of the drilling hole 5, which assists the scavenging of the wall.

FIG. 2 depicts the component of the velocity vector $v_D$ of the drilling fluid, this vector having an axial component $v_a$ and a radial component $v_r$, which allows an entrainment of the fluid and debris towards the wall of the hole 5 and thus the recirculation thereof in the space 5'.

Thus the circulation of the fluid and debris and the scavenging of the hole are facilitated and an accumulation of debris against the wall of the hole is prevented. In this way the coefficients of axial and tangential friction of the drill pipe string inside the drilling hole 5 are reduced. There is also obtained, at the bearing area 8, a fluid bearing effect which assists the sliding of the drill pipe. The risks of sticking of the drilling equipment through differential pressure are also limited, in particular in the parts of the drilling hole which are highly inclined with respect to the vertical.

FIG. 2 shows the angular rotation speed Ω about the axis 2 of the profiled element 1 of the drilling equipment assisting a gyratory movement of the drilling fluid and of the debris superimposed on the deflection effect under the effect of the inclined wall, which makes it possible to obtain a helical circulation 11 around the element 1 (as shown in FIG. 2).

Figure 3:
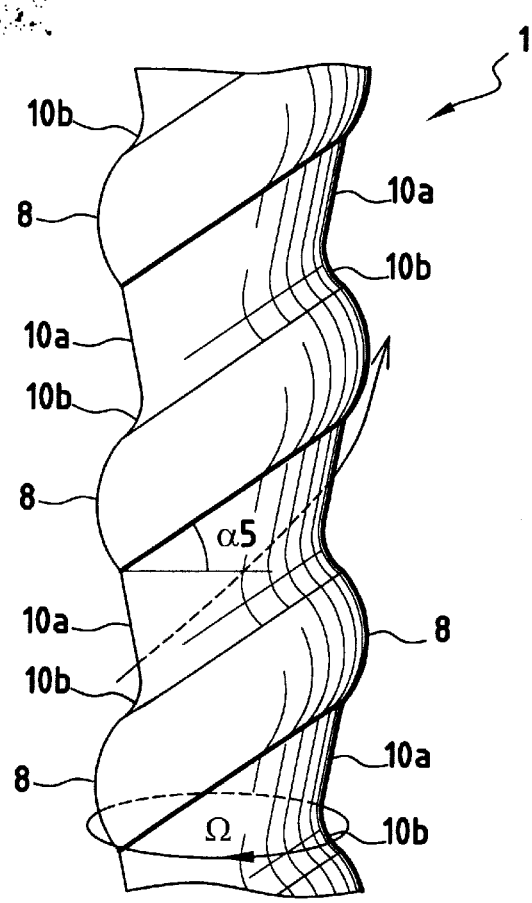
FIG. 3 is an elevation view of a profiled element according to the first embodiment and according to a first variant.

FIG. 3 depicts a variant embodiment of the profiled element 1 according to the first embodiment, the profiled element 1 having a succession of abutment areas 8, deflection areas 10*a* and turbulence areas 10*b*, these successive areas of the profiled element being disposed in a helix with an angle of inclination $\alpha_5$.

It should be noted that the angle of inclination $\alpha_5$ of the helix 12 according to which the profiled areas of the element 1 are disposed is defined with respect to a transverse plane perpendicular to the axis 2 rather than with respect to the axis 2, like the angles $\alpha_1$, $\alpha_2$, $\alpha_3$ and $\alpha_4$. The angle $\alpha_5$ of the helix with respect to the transverse plane defines the inclination of the helix parts directed towards the right and from bottom to top, the direction of winding of the helix in the direction of progress of the drilling being the same as the direction of rotation of the drilling equipment (rotation Ω in the clockwise direction observed from the surface).

The angle $\alpha_5$ is preferably in the range:

$$0 \leqq \alpha_5 < 75°.$$

The angle $\alpha_5$ can for example be around 45° or be between 30° and 60°.

In all cases, the entrainment effect of the drilling fluid and debris is increased by the succession of the deflection 10*a* and turbulence 10*b* areas and by a screw effect due to the helical shape and to the direction of winding of the helix of the profiled element.

In addition, the screw effect assists the transmission of a thrust on the tool fixed to the end of the drilling equipment.

The profiled element depicted in FIG. 3 complies with the general definition of an element of revolution about the axis of the element, taking account of an axial movement of the meridian, in a continuous manner during the generation of the profile of revolution about the axis.

Figure 4:
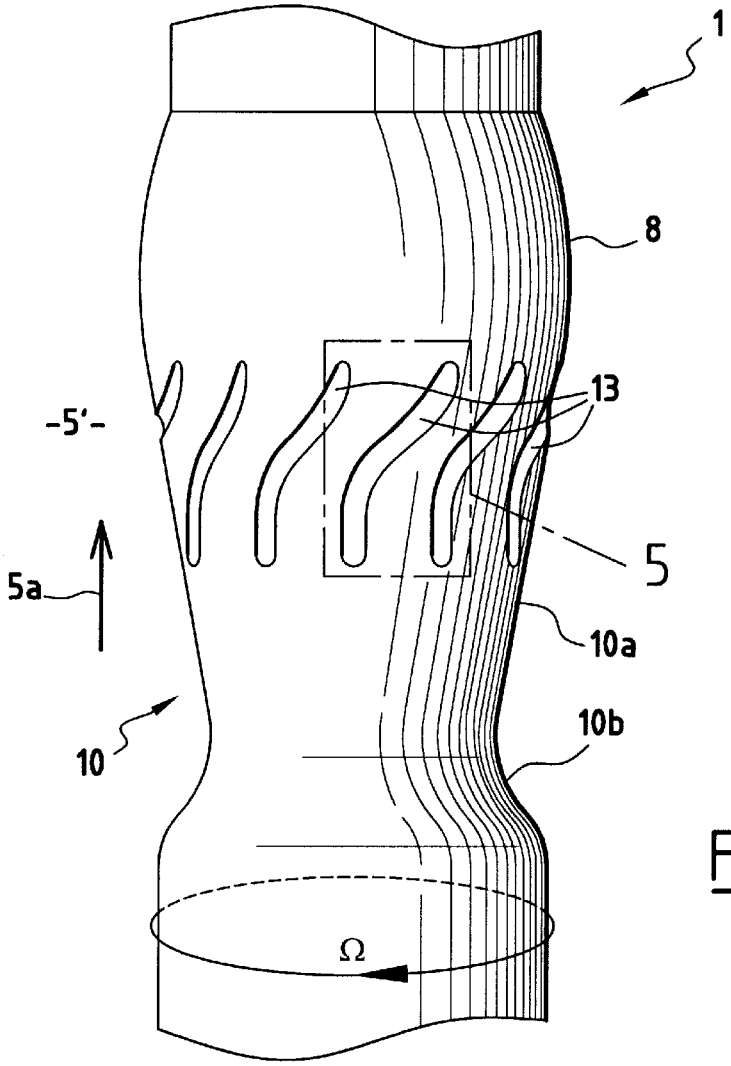
FIG. 4 is an elevation view of a profiled element according to the first embodiment of the invention and according to a second variant.

FIG. 4 shows a second variant embodiment of the profiled element 1 according to the invention and according to the first embodiment.

In this embodiment, the deflection area 10*a*, which has a contour with a general shape similar to that of the area 10*a* of the profiled element shown in FIG. 1, also has cavities 13 machined in the external surface of frustoconical shape.

Figure 5:
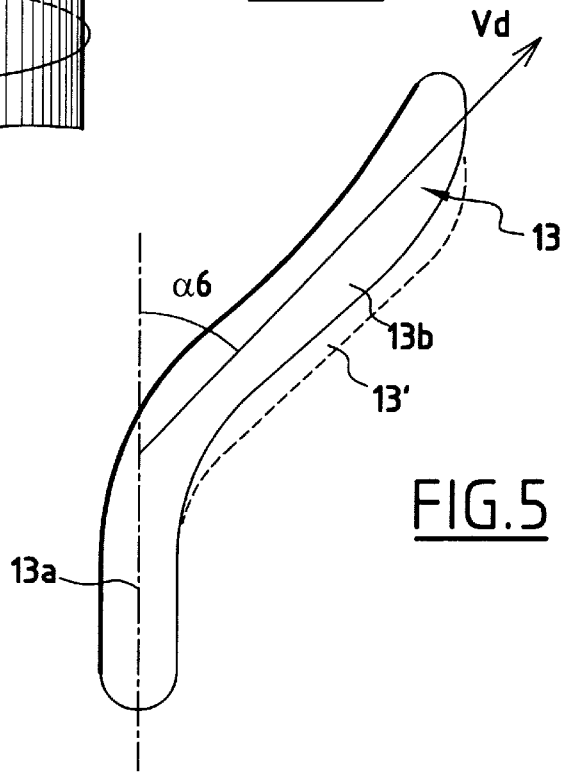
FIG. 5 is a view to a larger scale of the detail 5 in FIG. 4.

Each of the openings 13, as can be seen in particular in FIG. 5, has a first part 13*a* with a substantially axial direction and a second part 13*b* in line with the part 13*a* with an inclined direction forming an angle $\alpha_6$ with the longitudinal axis 2 of the profiled element. The inclination $\alpha_6$ of the inclined part 13*b* directed towards the right and from bottom to top on the profiled element assists a helical flow of the drilling fluid and an entrainment of the debris upwards.

As can be seen in FIG. 4, the drilling fluid circulating in the annulus 5' around the profiled element of the drilling equipment, as shown by the arrow 5*a*, is diverted laterally by the cavities 13, as shown by the velocity vector $v_D$ at the outlet from the cavities 13.

As before, the vector $v_D$ is inclined with respect to the axis in the direction of the wall of the drilling hole 5 so as to obtain the required effect of circulation and scavenging of the debris.

It should be noted that, in the case of the second variant embodiment, the effect of lateral diversion of the drilling fluid is obtained at a zero speed of rotation of the drilling equipment, that is to say for $\Omega=0$, because of the inclination of the cavities 13.

Optionally, one of the edges 13' of the cavities 13 can have a part machined in an undercut directed towards the rear considering the rotational movement at speed $\Omega$ of the profiled element (in the clockwise direction seen from above the profiled element), so as to ensure better stirring of the drilling fluid and better activation of the circulation of this drilling fluid and the debris. The area of turbulence 10*b* and the deflection area 10*a* are then partially merged.

Figure 6:
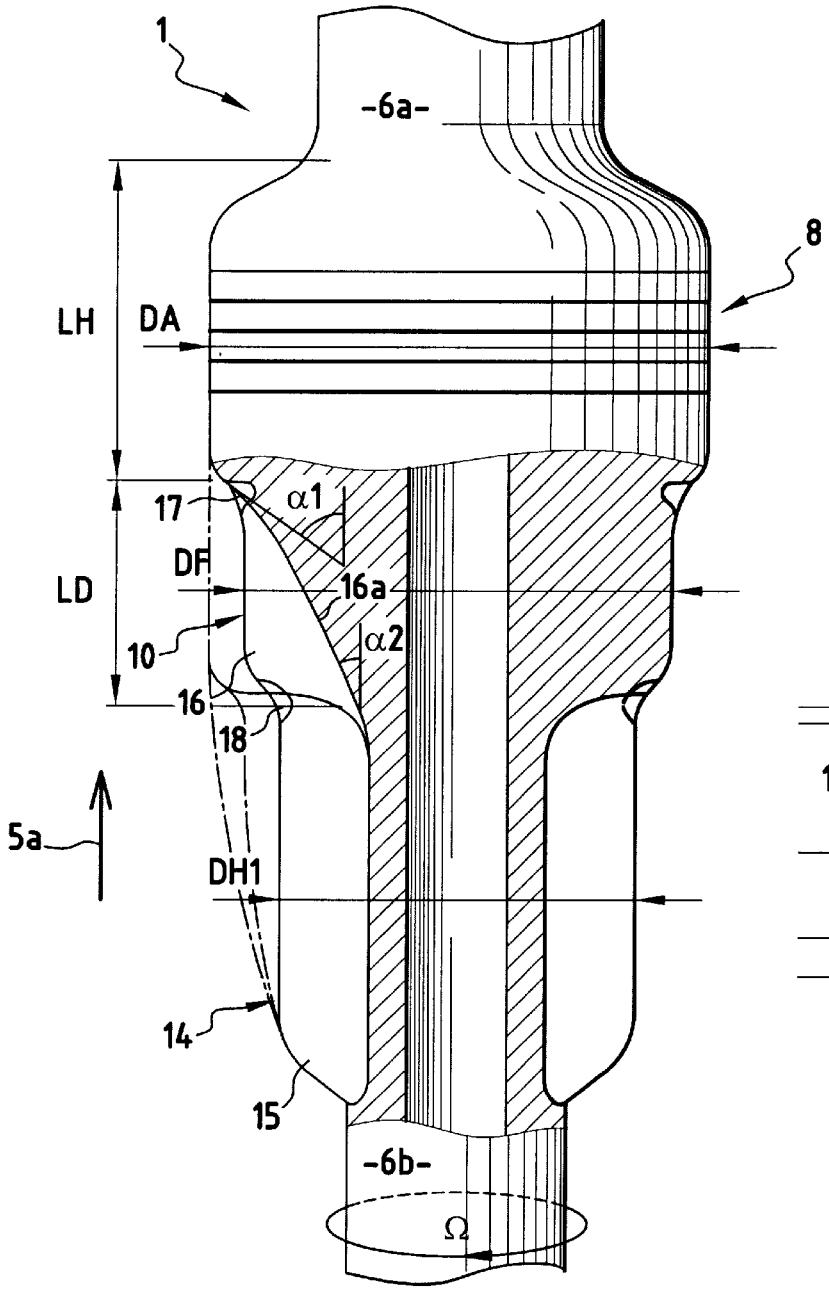
FIG. 6 is an elevation view in partial section of a profiled element according to the invention and according to a second embodiment.

FIG. 6 depicts a second embodiment of the profiled element 1.

The profiled element 1 according to the second embodiment depicted in FIG. 6 repeats certain features of the device according to FR-99 01391.

The prior patent describes a profiled element having a bearing area in which grooves and projecting parts are machined in helical arrangements, the grooves and projecting parts having geometric characteristics variable in the axial direction of the profiled element, so as to create a circulation of fluid around the bearing element assisting the sliding of the bearing element, by hydrodynamic bearing effect.

According to a preferential embodiment, the profiled element has, downwards in line with the bearing area, an area for activation of the circulation of the fluid having grooves machined in line with the grooves of the bearing part whose profile, which can in particular have an undercut, provides a stirring and rising of the drilling fluid and debris inside the annulus around the drilling equipment.

The profiled element 1 according to the second embodiment of the invention depicted in FIG. 6 has, between a top connection area 6*a* and a bottom connection area 6*b* whose outside diameter is substantially equal to the nominal diameter $D_N$ of the drilling element, a bearing area 8, a deflection area 10 characteristic of the profile according to the invention and an area 14 for activation of the fluid circulation, or turbulence area, which can be similar to the fluid activation area of the device according to the prior art.

The bearing area 8 can have a cylindrical shape and, in this area, the profiled element can have, on its external surface, anti-wear linings having the form of annular segments.

The area 8 can have, as described above, a toric, spherical or ovoid shape.

In the stirring area 14, or turbulence area, the profiled element, which has a general cylindrical shape, is machined so as to have hollow grooves 14 in helixes having as their axis the axis 2 of the profiled element and having a transverse section in a plane perpendicular to the axis 2 which can include an undercut part, as described in the prior patent.

The grooves 15 can also have a symmetrical profile whose effect of activation of the drilling fluid and of the debris is less than the effect produced by the grooves with asymmetric cross-section having an undercut towards the rear of the grooves (looking in the direction of rotation of the drilling equipment).

The outside diameter of the profiled element in the turbulence area 14 is designated $D_{H1}$.

The angle of inclination of the helixes consisting of the grooves 15, substantially constant in the axial direction of the turbulence area 14, is designated $\beta_1$.

According to the invention, a deflection area 10 is interposed between the bearing area 8 and the turbulence area 14.

Figure 7:
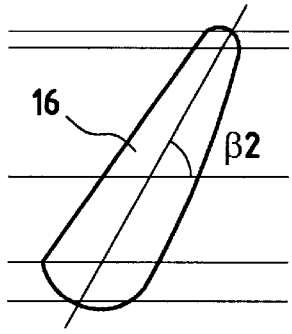
FIG. 7 is a view, developed in the circumferential direction, of part of the profiled element depicted in FIG. 6.

In the area 10, as can be seen in FIGS. 6 and 7, the profiled element 1 whose substantially cylindrical external surface has a diameter $D_F$, has opening-out grooves 16 disposed in helixes having as their axis the axis 2 of the profiled element, with variable depth in the axial direction 2, whose bottom has a meridian 16*a* (visible in FIG. 6) in the form of a line inclined with respect to the axis 2 of the profiled element, in a direction such that the meridian line 16*a* moves away from the axis 2, when moving from bottom to top, that is to say from the turbulence area 14 towards the abutment area 8.

The meridian line 16*a* also has an increasing inclination with respect to the direction of the axis 2, in the direction going from the turbulence area 14 towards the abutment area 8.

If $\alpha_1$ and $\alpha_2$ are used to designate the angles of the tangents to the meridian line 16*a* with the axial direction at its ends adjacent to the abutment area 8 and to the turbulence area 14, respectively, this gives:

$$\alpha_1 \geqq \alpha_2.$$

The inclination of the meridian line 16*a* in the deflection area 10 with respect to the axial direction 2 increases continuously over the entire length of the meridian line of the turbulence area 14 to the abutment area 8.

If $D_A$ is used to designate the diameter of the abutment part, the general external shape of the profiled element is defined by the following inequalities:

$$D_A > D_F > D_{H1}.$$

In addition, FIG. 6 shows in dotted lines the contour of a profiled element which would be produced according to the prior patent FR-99 01391. In the case of the prior patent, the grooves of the turbulence area and of the abutment area (which extend along the lengths $L_H$ and $L_D$ of the abutment and deflection areas of the profiled element according to the invention) are machined continuously and in line with each other, in the turbulence area and in the abutment area.

In the case of the invention, the turbulence 14 and deflection 10 areas are completely separate and the abutment area 8 can be free of any variable-geometry grooves, in line with the grooves in the turbulence area.

The abutment area 8 on the one hand and the deflection 10 and turbulence 14 areas on the other hand are completely separate.

It is possible to machine a groove 17 constituting a shoulder and a separation fillet between the grooves 16 of the deflection area and the abutment area 8.

Likewise, an annular fillet 18 separates the stirring grooves 15 in the turbulence area 14 from the grooves 16 in the deflection area 10*a*.

It can be seen in FIG. 7 that the variable-depth grooves 16 having a helical angle of inclination $\beta_2$ have a decreasing width when going from bottom to top, that is to say from the turbulence area 14 towards the abutment area 8.

Figure 8A:
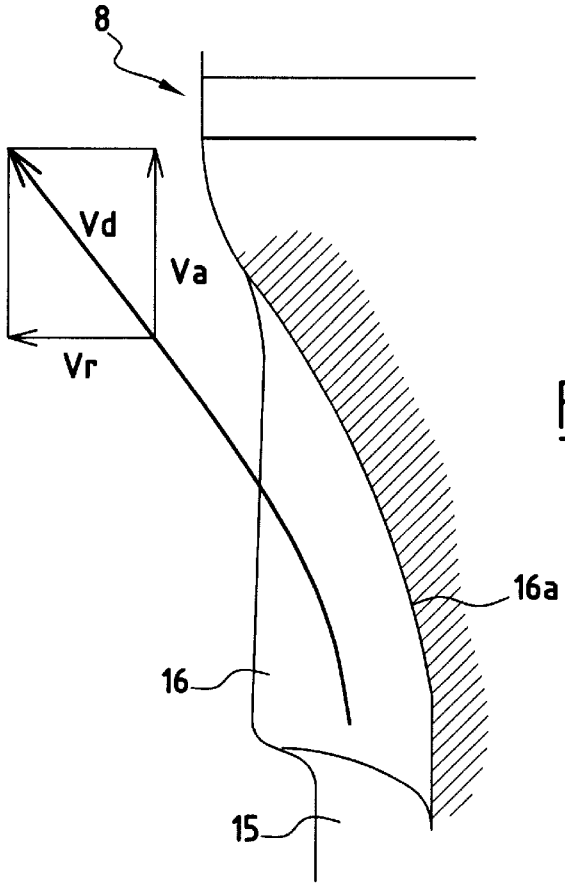
FIG. 8A is a view to a larger scale of a detail of FIG. 6.

As can be seen in FIG. 8A, in the deflection area 10, the grooves 16 whose bottom 16*a* is inclined outwards, from bottom to top, produce a deflection of the drilling fluid whose velocity vector $v_D$ at the outlet from the groove 16 has been shown in FIG. 8A.

The vector $v_D$ has an axial component $V_A$ and a radial component $v_R$.

Figure 8B:
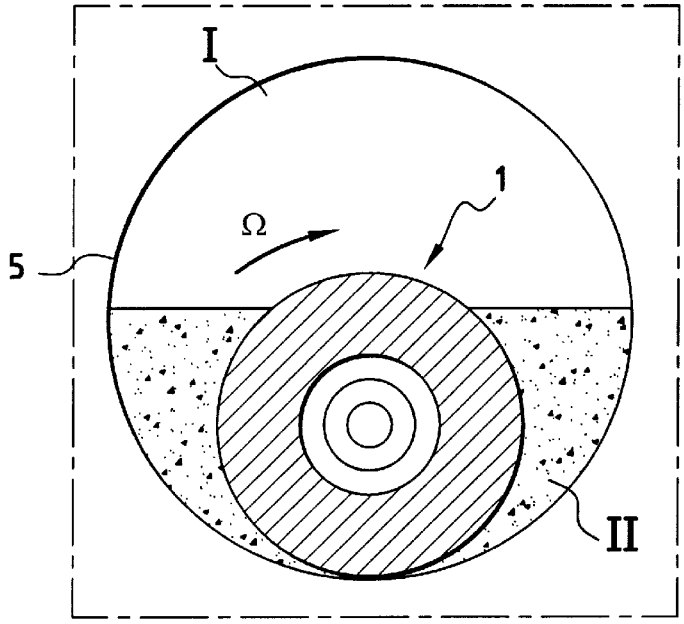
FIG. 8B is a schematic view, in transverse section, of a profiled element according to the invention, in the service position in the drilling hole.

FIG. 8B shows the profiled element 1 seen from the surface, in a part of the drilling hole 5 which is greatly inclined with respect to the vertical or even substantially horizontal. The radial component $v_R$ of the velocity vector assists the return to circulation of the debris in the bottom part II towards the top part I of the drilling hole and produces a scavenging of the wall of the hole.

Figure 9:
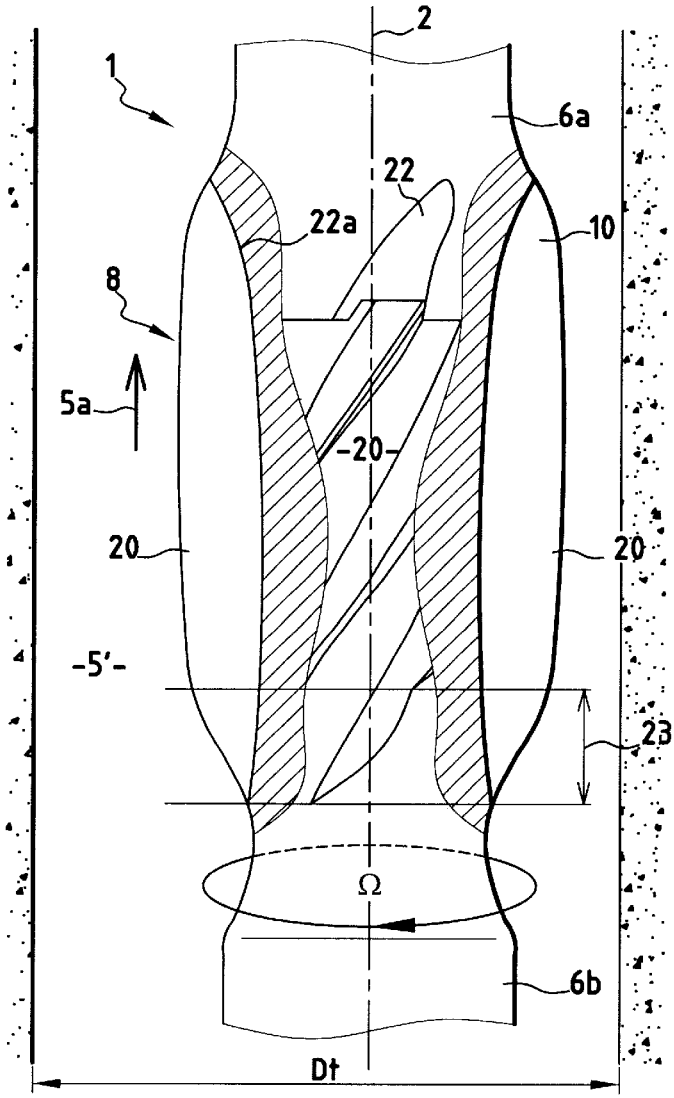
FIG. 9 is an elevation view of a profiled element according to the invention and according to a third embodiment.
Figure 10:
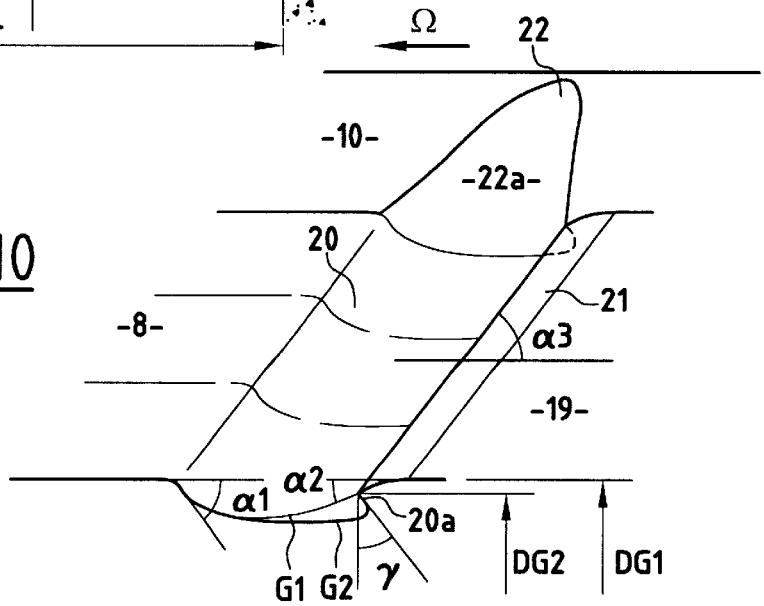
FIG. 10 is a view, developed in the circumferential direction, of part of the profiled element depicted in FIG. 9.

In addition, the rotation of the pipe and/or the helical inclination of the grooves 16 make it possible to obtain an effect of helical driving of the drilling fluid around the axis 2 of the profiled element FIGS. 9 and 10 depict a third embodiment of a profiled element according to the invention.

The profiled element designated in general terms by the reference 1 of tubular shape and having an axis 2 has, between a top connecting end part 6*a* and a bottom connecting end part 6*b*, a deflection area 10 and an abutment area 8 which is produced so as to provide a stirring of the drilling fluid and of the debris and a scraping of the drilling hole, that is to say the functions of a turbulence area.

In other words, in the case of the third embodiment, the abutment area and the turbulence area are merged in the area 8.

The end connecting areas 6*a* and 6*b* have a diameter $D_N$ which is the nominal diameter of the drilling element on which the profiled element 1 is disposed.

As can be seen in particular in FIG. 10, the grooves 20 of the abutment and turbulence area 8 have a transverse profile whose rear part, in the direction of rotation Ω of the equipment and of the profiled element, have a substantially straight undercut part 20*a* producing an effect of stirring and entrainment of the drilling fluid and debris when the drilling equipment is rotated.

The rear part of the grooves 20 is connected to an adjacent part 19 of the surface of the abutment area 9 by means of an inclined surface 21 forming an angle $\alpha_2$, on the developed view in FIG. 10, with the circumferential direction of the abutment area 8.

In the deflection area 10, the grooves 20 are extended axially by deflection grooves 22 whose bottom 22*a* has a meridian inclined with respect to the axis 2 of the profiled element, so as to move away from the axis when moving from bottom to top.

In general terms, the grooves 20 and the grooves 22 are disposed on helixes having as their axis the axis 2 of the profiled drilling element 1.

Between the bottom connection area 6*b* of the profiled element and the abutment area 8 there is provided a drilling fluid transfer area 23 in which the end parts of the grooves 20 extend.

The drilling fluid enters the grooves 20 at the transfer area 23 and is, in the abutment and turbulence area 8, subjected to particularly intense stirring and agitation, when the grooves 20 have a rear part 20*a* machined in an undercut.

In addition, the grooves 20 can be machined so that their depth is variable and decreasing in the direction of the circulation of the fluid, so as to increase the fluid bearing effect by passage of the drilling fluid from the grooves 20 above the inclined surface 21 forming an angle $\alpha_2$ with the surface of the abutment area 19.

As shown in FIG. 10, the grooves 20 are machined so as to have a profile $G_1$ without an undercut and then remachined in order to have the profile $G_2$ including the part 20*a* as an undercut at the rear of the groove 20 in the direction of rotation Ω.

The undercut part 20*a* has a flat surface at the rear of the groove 20 forming an angle γ with the radial direction of the profiled element. The first profile $G_1$ of the grooves 20 has an inlet part (looking in the direction of rotation Ω of the drilling equipment) whose tangent forms, with the circumferential direction of the profiled element, an angle $\alpha_1$ generally very much greater than the angle $\alpha_2$, with the circumferential direction, of the part of the grooves 20 connecting to the abutment area 19, at the outlet from the grooves 20.

In all cases, the diameter $D_{G1}$ of the abutment part 19 is greater than the diameter $D_{G2}$ of the profiled element at the outlet from the groove 20, at the external part of the undercut surface. In this way, the profiled element 1 never comes into contact with the wall of the drilling hole along the outlet part of the grooves 20 and a fluid bearing effect is achieved along the inclined surface 21 joining the outlet part of the grooves 20 to the abutment area 19.

In general terms, the profiled element 1 according to the third embodiment is defined by the conditions given below:

$$D_{G2}>D_N$$

$$D_{G1}>D_N$$

$$D_{G2}<D_{G1}$$

$$\alpha_1>>\alpha_2$$

$$\gamma<0$$

(undercut angle taking account of the direction of rotation Ω).

In particular, the diameter $D_{G2}$ of the profiled element 1 at the outlet part of the grooves 20, in the transverse direction, looking in the direction of rotation Ω of the drilling equipment, is always less than the diameter $D_{G1}$ of the profiled element at the abutment areas 19. The outlet part of the grooves never comes into contact with the drilling hole and fluid bearing effect is obtained along the inclined connection surface.

Where $D_{G1}$ is substantially equal to or slightly less than $D_t$, the drilling equipment has the role of a stabiliser.

In this case, the abutment areas 19 of the profiled element 1 at which the diameter $D_{G1}$ of the profiled element is at a maximum constitute the blades of the stabiliser.

In addition, as can be seen in FIG. 10, the grooves 20 are disposed on a helix forming an angle $\alpha_3$ with the transverse direction plane of the profiled element.

The angle $\alpha_3$ can be constant or increasing along the length of the grooves or variable, so as to obtain the best possible effect of acceleration of the rate of circulation of the drilling fluid and entrainment of the drilling debris, by Archimedean screw effect. In some cases, undercut machining according to the profile $G_2$ of the grooves 20 is not necessary if a particularly marked effect of turbulence and cleaning of the drilling hole is not sought.

FIGS. 11 to 18 show various drilling elements comprising profiled elements according to the invention.

Figure 11:
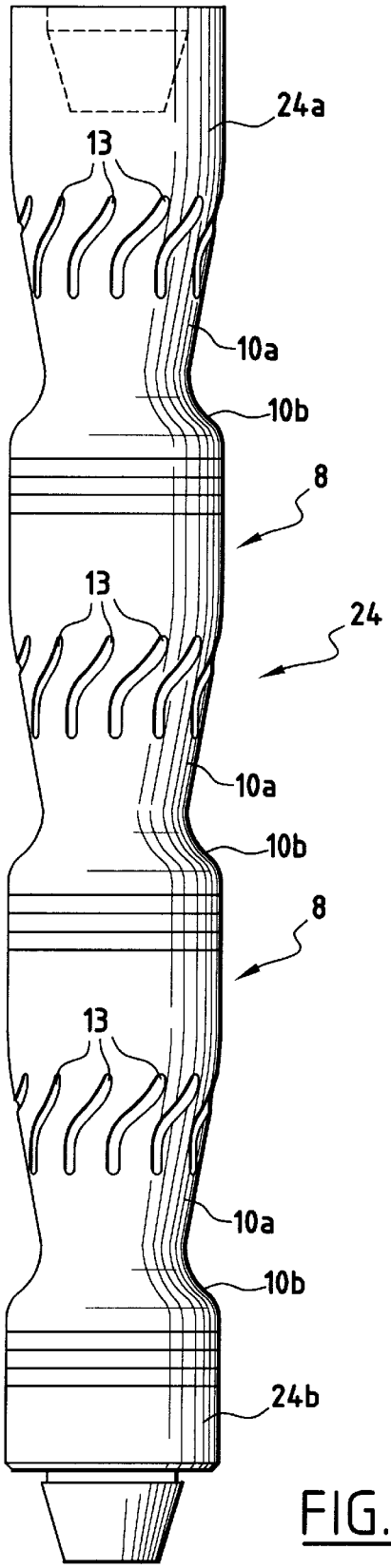
FIG. 11 is a lateral elevation view of a drill collar having a profiled element according to the second variant of the first embodiment of the invention.
Figure 12:
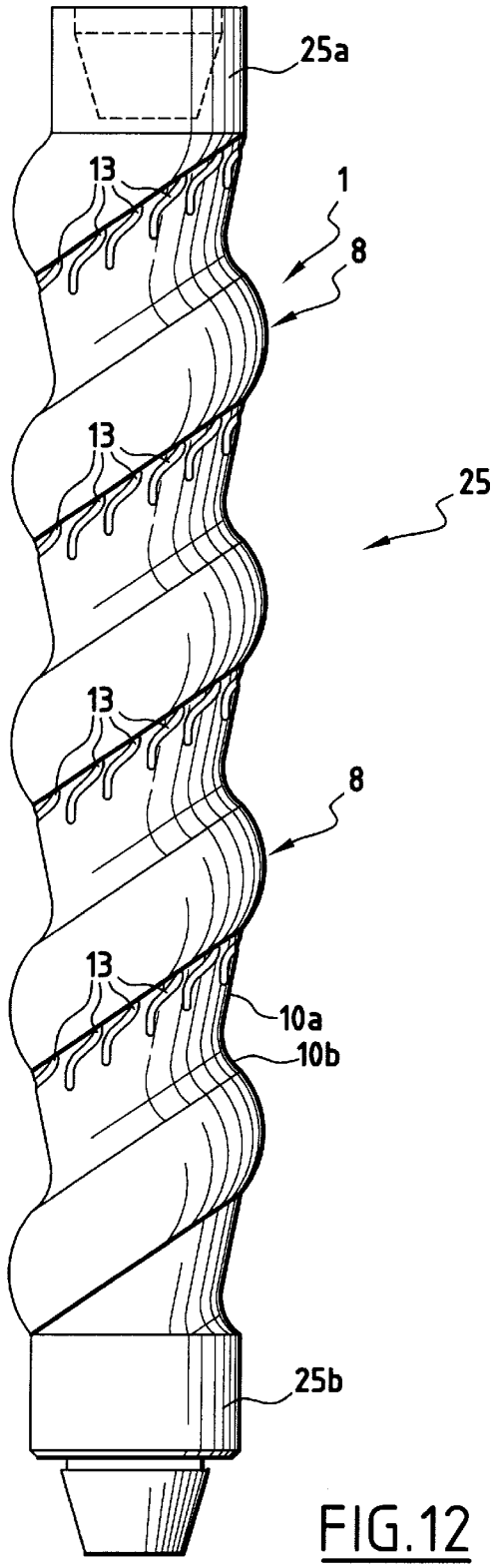
FIG. 12 is a lateral elevation view of a drill collar having a profiled element according to the first variant embodiment of the first embodiment of the invention.

FIGS. 11 and 12 show drill collars 24 and 25 which comprise several successive profiled elements 1 according to the invention.

The drill collars of the drill pipe strings have connecting end parts such as 24*a*, 24*b* and 25*a*, 25*b* at their ends having respectively female and male threads, of conical shape, allowing the connection of the ends of the drill collar to an element of the pipe string having a corresponding male or female connection element.

The nominal diameter $D_N$ of the drill collar is the diameter of the end connecting parts, with respect to which the characteristic diameters of the profiled elements 1 according to the invention are defined.

In the case of the drill collar 24 depicted in FIG. 1, the profiled elements 1 are produced according to the second variant of the first embodiment.

The profiled elements 1 which are placed successively in the axial direction of the pipe have an abutment area 8 whose external surface has a cylindrical shape, toric or spherical, a deflection area 10*a* in which cavities 13 are provided, assisting the lateral deflection of the fluid whatever the speed of rotation of the drill collar and possibly the stirring and turbulence of the circulation of the drilling fluid, and finally a turbulence area 10*b* in which the drilling fluid can be in the form of a swirling flow.

The drill collar 25 shown in FIG. 12 has successive profiles 1 disposed in a helix according to the first variant of the first embodiment of the invention. In this way an Archimedean screw effect and a mechanical thrust on the tool are obtained, improving the transmission of the weight of the drill pipe string towards the drilling tool and a hydraulic effect of entrainment of drilling fluid and debris upwards. Each of the profiled elements 1 has an abutment area 8, a deflection area 10*a* and a turbulence area 10*b* able to come into contact with projecting parts of the wall of the hole 5. In addition, in the deflection area 10*a*, there are machined cavities 13 according to the second variant of the first embodiment of the invention.

FIGS. 13, 14, 15 and 16 depict drill pipes 27, 28, 29 and 30 incorporating profiled elements 1 according to the invention placed successively in the axial direction 2 of the drill pipe.

The drill pipes depicted in FIGS. 13 to 16 can be drill pipes such as heavy pipes or other types of intermediate pipe. Such drill pipes have at their ends connecting pieces (threaded conical pieces such as 27*a*, 27*b* (with regard to the pipe 27 depicted in FIG. 13) whose diameter is greater than the diameter $D_N$ of the drill pipe, that is to say the diameter of the main part of the drill pipe between its connecting ends such as 27*a* and 27*b*.

The profiles 1 according to the invention distributed along the length of the drill pipe are defined with respect to the diameter $D_N$ of the drill pipe.

Figure 13:
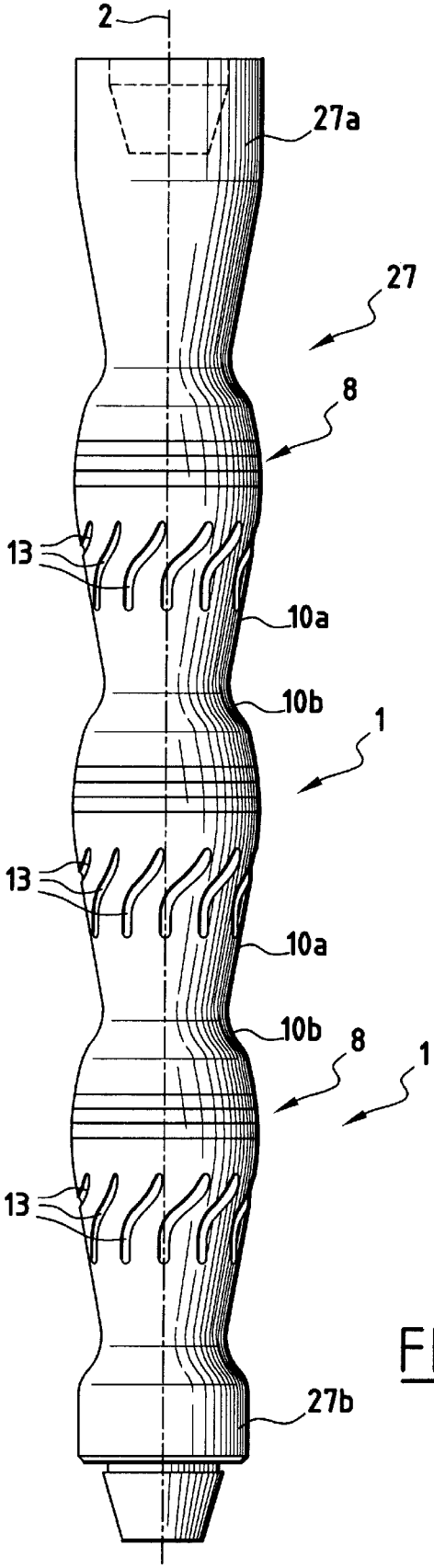
FIG. 13 is an elevation view of a drill pipe comprising profiled elements according to the second variant of the first embodiment of the invention.

The drill pipe 27 depicted in FIG. 13 comprises successive profiled elements 1 produced according to the second variant of the first embodiment.

Each of the profiled elements has an abutment area 8 whose external surface can be toric, spherical or cylindrical, a deflection area 10*a* and a turbulence area 10*b*.

In the deflection area 10*a* there are provided cavities 13 for obtaining a lateral diversion of the drilling fluid independently of the rotation of the pipe 27 and, possibly, a stirring of the drilling fluid. A turbulence area 10*b* is produced between each deflection area 10*a* and the abutment area 8 of an adjacent profiled element.

Figure 14:
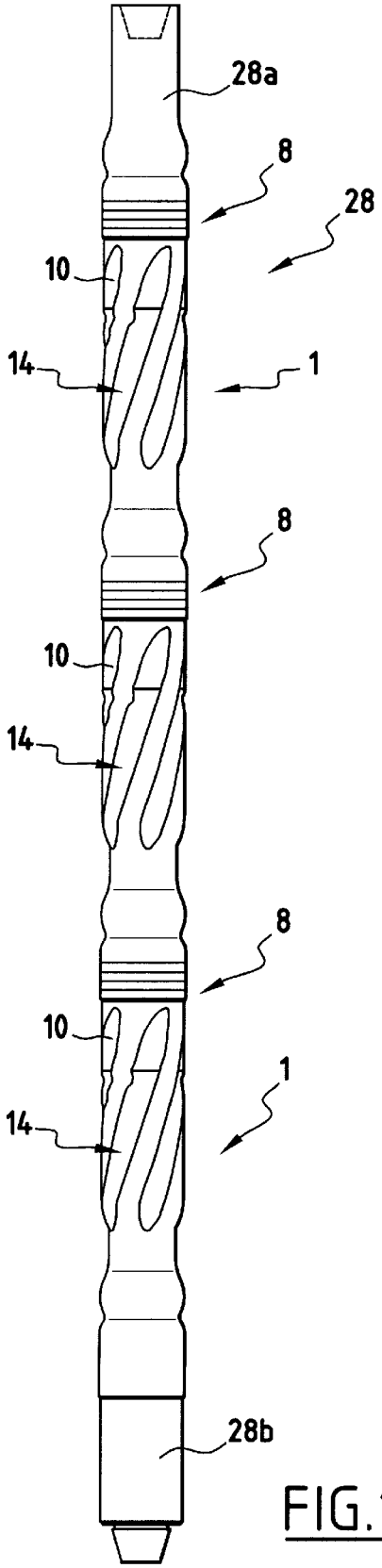
FIG. 14 is an elevation view of a drill pipe comprising profiled elements according to the second embodiment of the invention.

FIG. 14 shows a drill pipe 28 having profiled elements 1 according to the invention and according to the second embodiment.

Each of the profiled elements comprises an abutment area 8 which can have a cylindrical external surface, a deflection area 10 and a turbulence area 14 which can have grooves with an undercut profile.

Figure 15:
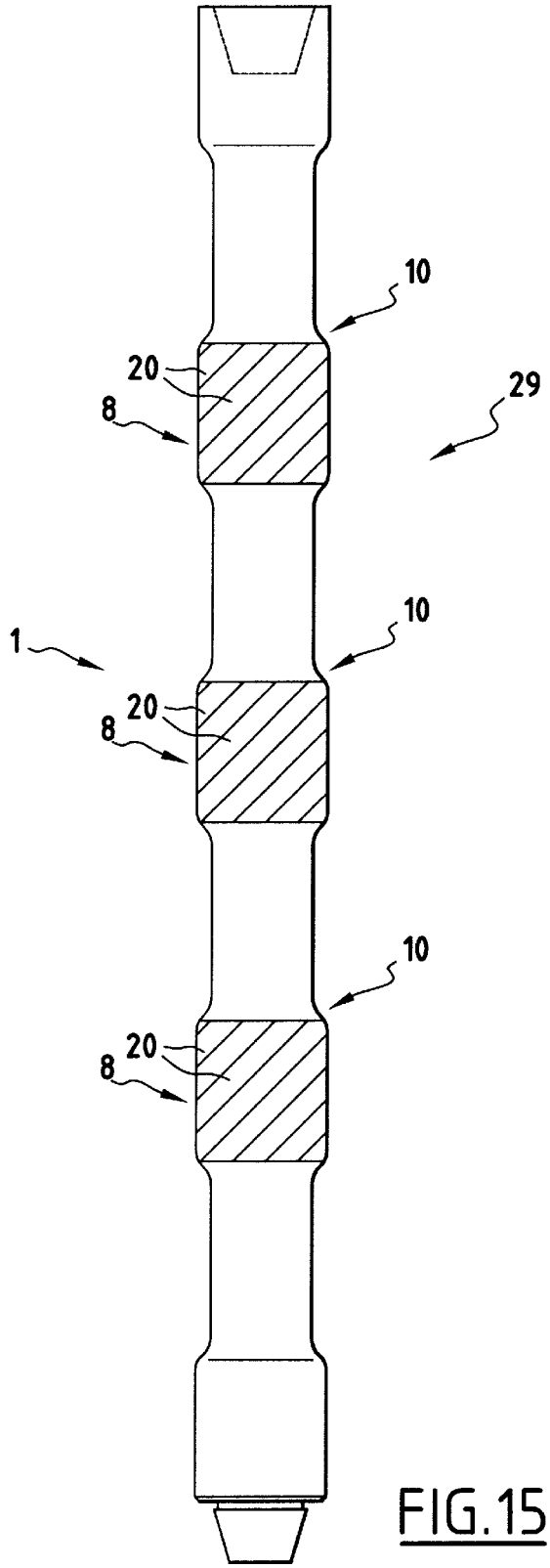
FIG. 15 is an elevation view of a drill pipe comprising profiled elements according to the third embodiment of the invention.

FIG. 15 shows a drill pipe 29 having successive profiled elements 1 according to the invention and according to the third embodiment.

Each of the profiled elements 1 has an abutment and turbulence area 8 and a deflection area 10 formed at the outlet from the grooves 20 of the abutment area 8.

Figure 16:
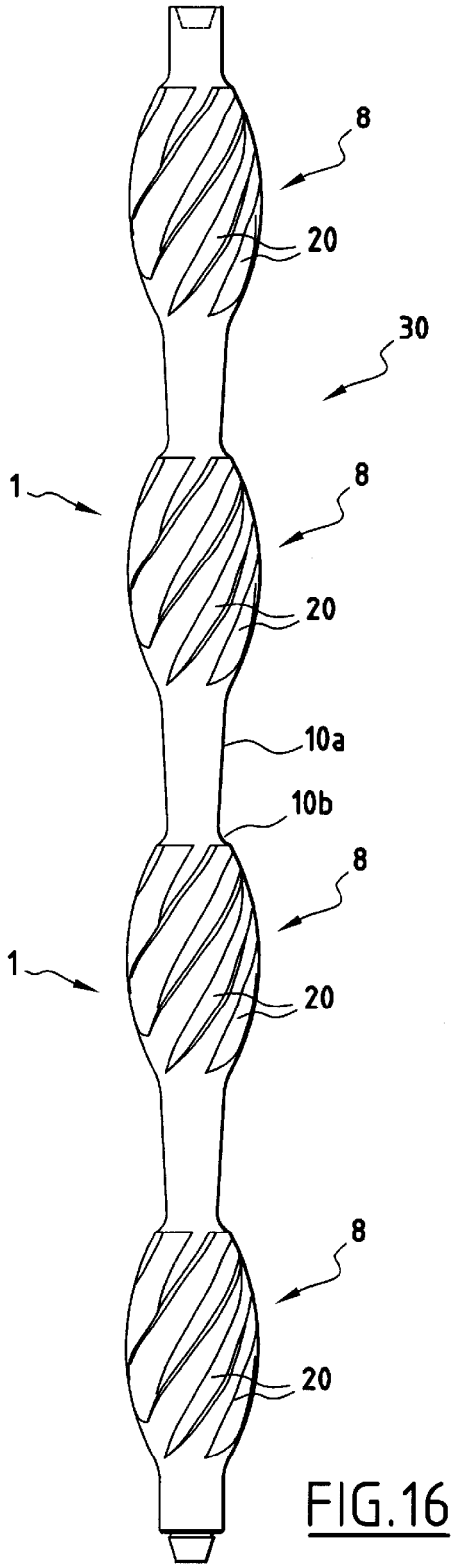
FIG. 16 is an elevation view of a drill pipe comprising profiled elements produced according to the first and third embodiments of the invention.

FIG. 16 shows a drill pipe 30 comprising profiled elements 1 combining the characteristics of the profiled elements according to the first and third embodiments.

The abutment areas 8 can have an external surface with a toric or spherical shape and grooves 20 produced according to the third embodiment providing a stirring of the fluid at the abutment areas 8, which also constitute turbulence areas.

The profile 1 is supplemented by a deflection area 10*a*, for example frustoconical in shape, and a turbulence area 10*b* interposed between the deflection area 10*a* and an abutment and turbulence area 8 of an adjacent profiled element 1.

Figure 17:
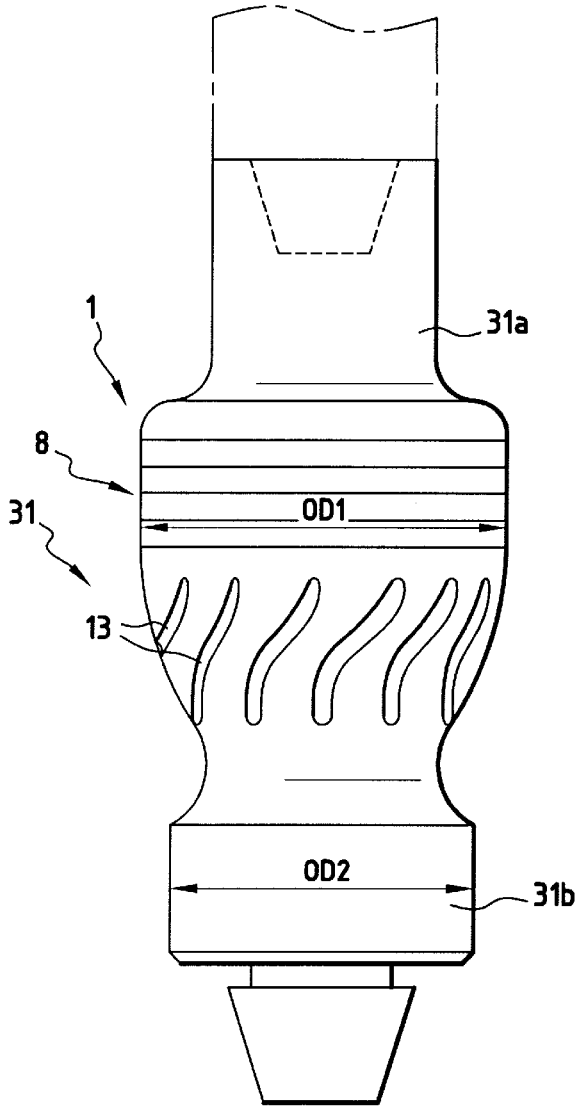
FIG. 17 is a side elevation view of a tool joint comprising a profiled element according to the second variant of the first embodiment of the invention.
Figure 18:
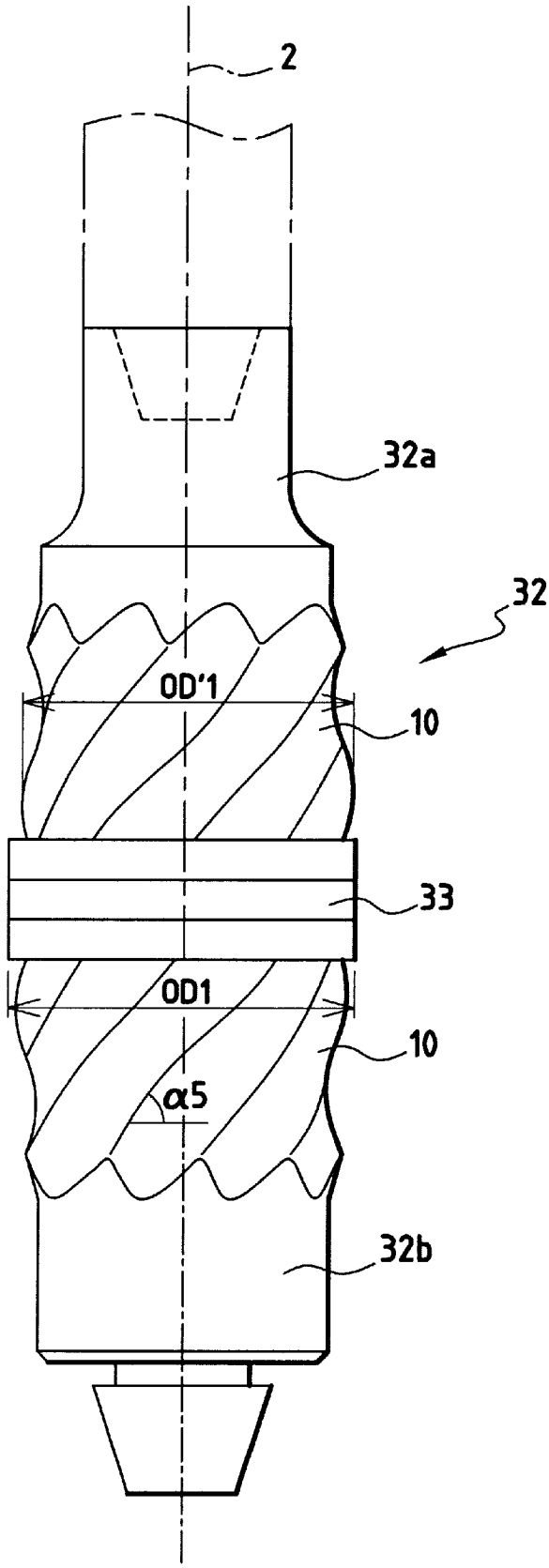
FIG. 18 is a side elevation view of a tool joint comprising two profiled elements according to the first embodiment of the invention separated by a cylindrical area.

FIGS. 17 and 18 show elements of a drill string providing the connection of components of the drill pipe string, these elements being referred to as "tool joints". In general terms, the embodiments relating to the tool joint shown in FIGS. 17 and 18 will apply to any intermediate connection between two components of a drill string constituting the drilling equipment.

The tool joint or intermediate coupling such as 31 has end connection parts 31*a* and 31*b* making it possible to change from a first diameter of the drill string to a second diameter greater than the first, allowing the connection of a component.

The tool joint 31 or intermediate coupling has a profiled element 1 according to the invention and according to the second variant of the first embodiment.

The element 1 has a generally spherical external surface, toric or cylindrical, and has an abutment area 8 at which the profiled element 1 has its maximum diameter $OD_1$, and a deflection area 10 at which there are machined cavities 13 providing the lateral deflection and stirring of the drilling fluid.

The diameter $OD_2$ of the bottom connection part 31*b* of the tool joint is less than the maximum diameter $OD_1$ of the abutment area 8, so that the abutment of the tool joint on the drilling hole takes place only at the maximum diameter of the abutment area.

FIG. 18 depicts a tool joint or intermediate coupling 32 having, on each side of a generally cylindrical central abutment area 33, two profiled elements 1 produced according to the first variant of the first embodiment of the invention, that is to say having abutment areas 8 of maximum diameter $OD'_1$ and deflection and turbulence areas 10 placed at helixes inclined by an angle $\alpha_5$ with respect to the transverse plane perpendicular to the axis 2 of the tool joint. The diameter of the tool joint 32 is at a maximum and equal to $OD_1$, in the central abutment area 33. $OD'_1$ is slightly less than or equal to $OD_1$.

It is also possible to conceive at least one threaded end coupling of a drill pipe machined so as to comprise at least one profiled element according to the invention. The two threaded end couplings of a drill pipe can comprise at least one profiled element according to the invention.

In all cases, the profiled elements according to the invention make it possible to assist the circulation of the drilling fluid and of the drilling debris, to clean the surface of the drilling hole, to assist the sliding of the pipe string inside the drilling hole and the mechanical transmission of the weight towards the drilling tool, and to prevent sticking of the drill pipe string in the drilling hole, whatever the inclination of the drilling hole with respect to the vertical.

The invention is not strictly limited to the embodiments which have been described.

It is possible to imagine certain variant embodiments of the profiles, combining for example the characteristics of the profiles according to the three embodiments and according to their variants described above.

The invention applies to any element of a drill pipe string and in particular to the drill pipe string elements used for directional drilling.

I claim:

1. A profiled element for rotary drilling equipment, having an axis of rotation, for producing a drilling hole defining a wall, the profiled element having an overall shape of revolution and an axis directed along the axis of rotation of the drilling and at least one area of abutment on the wall of the drilling hole extending in the axial direction of the profiled element and having a maximum diameter constituting the maximum diameter of the drilling equipment and a turbulence area for producing an activation of circulation of a drilling fluid in the drilling hole around the drilling equipment, wherein the profiled element further includes a deflection area, in an adjacent position between the abutment area and the turbulence area and extending in the axial direction of the profiled element, comprising an external surface, of revolution around the axis of the drilling equipment, that is inclined with respect to the axis of the drilling, with a meridian line in an axial plane that moves away from the axis of the profiled element in a direction proceeding from bottom to top in a service position of the profiled element in the drilling hole.

2. A profiled element according to claim 1, wherein the profiled element has at least one abutment surface having an external surface of a shape selected from the group consisting of toric, spherical and cylindrical shapes and a deflection area having an external surface of frustoconical shape.

3. A profiled element according to claim 2, wherein the external surface of the deflection area has a narrowed part and wherein the profiled element has at least one turbulence area adjacent to the narrowed part of the external surface of the deflection area having an external surface with a concave shape delimiting an area for stirring of the drilling fluid.

4. A profiled element according to claim 3, wherein an angle ($\alpha$4) of a tangent to the meridian of the profiled element with the axial direction of the profiled element, at the bottom part of the turbulence area, is substantially greater than the angle of the tangent to the meridian of the profiled element with the axial direction at the top part of the deflection area at a point where it is connected to the abutment area.

5. A profiled element according to claim 3, wherein the abutment areas, deflection areas and turbulence areas of the profiled elements are disposed around the axis of the profiled element, in a helix forming a helix angle with respect to a transverse plane perpendicular to the axis of the profiled element, the helix being wound in a direction such that the rotation of the profiled element about its axis drives the drilling fluid and drilling debris upwards and exerts a downward mechanical thrust on the drilling equipment improving the transmission of the weight of the drilling equipment to a drilling tool.

6. A profiled element according to claim 1, wherein cavities are machined in the external surface of the deflection area of the profiled element, each of the cavities having, from bottom to top, in the direction of circulation of the drilling fluid, a part with a substantially axial direction and a part in line with the part forming an angle with the axial direction in a direction such that the drilling fluid and the drilling debris are driven upwards in a helical path.

7. A profiled element according to claim 5, wherein a rear edge of the cavities looking in the direction of rotation of the drilling equipment is machined in an undercut, so as to promote the stirring of the drilling fluid.

8. A profiled element according to claim 1, wherein the profiled element has an abutment area and a deflection area adjacent to the abutment area having a substantially cylindrical external surface in which there are produced grooves for circulation of the fluid extending generally axially, having an inclined surface with respect to the axis towards the outside of the profiled element in the direction proceeding from bottom to top, the deflection area being able to be completely separated from the abutment area by a shoulder or fillet at a top end for connection of the deflection area with the abutment area.

9. A profiled element according to claim 8, wherein the grooves in the deflection area have a depth decreasing between a first end of the deflection area away from the abutment area and a second end adjacent to the abutment area.

10. A profiled element according to claim 8, wherein the grooves in the deflection area have a width decreasing in the circumferential direction between the first end of the deflection area away from the abutment area and the second end of the deflection area adjacent to the abutment area.

11. A profiled element according to claim 8, wherein the inclination of the meridian line of the profiled element in the deflection area increases continuously along the entire length of the deflection area, from the turbulence area to the abutment area.

12. A profiled element according to claim 8, wherein the profiled element comprises a stirring area adjacent to a second end of the deflection area away from the abutment area, in which the external surface of general cylindrical shape of the profiled element has grooves with a general helical arrangement for stirring the drilling fluid, each of the grooves in the deflection area being in line with a groove in the turbulence area.

13. A profiled element according to claim 1, wherein the profiled element has an abutment and turbulence area in which the external surface of the profiled element of general cylindrical shape has grooves, generally with a helical arrangement about the axis of the profiled element and in an arrangement adjacent to the grooves, abutment areas and a deflection area comprising grooves disposed generally in line with the grooves in the abutment area having a surface inclined towards the outside with respect to the axis of the profiled element in the direction going from bottom to top in the service position of the profiled element in the drilling hole.

14. A profiled element according to claim 13, wherein the diameter of the profiled element at the exit part of the grooves in the transverse direction looking in the direction of rotation of the drilling equipment is less than the diameter of the profiled element at the abutment areas, an area providing a fluid bearing effect being interposed between the exit from the grooves and an adjacent abutment area.

15. A profiled element according to claim 13, wherein the meridian profile of the grooves has an inlet part, in the direction of rotation of the drilling equipment whose tangent forms, with the circumferential direction of the profiled element, an angle very much greater than the angle of the tangent to the exit part of the grooves connected to an adjacent abutment area, with the circumferential direction.

16. A drill pipe comprising at least one profiled element for rotary drilling equipment, having an axis of rotation, for producing a drilling hole defining a wall, the profiled element having an overall shape of revolution and an axis directed along the axis of rotation of the drilling and at least one area of abutment on the wall of the drilling hole extending in the axial direction of the profiled element and having a maximum diameter constituting the maximum diameter of the drilling equipment and a turbulence area for producing an activation of circulation of a drilling fluid in the drilling hole around the drilling equipment, wherein the profiled element further includes a deflection area, in an adjacent position between the abutment area and the turbulence area and extending in the axial direction of the profiled element, comprising an external surface, of revolution around the axis of the drilling equipment, that is inclined with respect to the axis of the drilling, with a meridian line in an axial plane that moves away from the axis of the profiled element in a direction proceeding from bottom to top in a service position of the profiled element in the drilling hole.

17. A drill collar comprising at least one profiled element for rotary drilling equipment, having an axis of rotation, for producing a drilling hole defining a wall, the profiled element having an overall shape of revolution and an axis directed along the axis of rotation of the drilling and at least one area of abutment on the wall of the drilling hole extending in the axial direction of the profiled element and having a maximum diameter constituting the maximum diameter of the drilling equipment and a turbulence area for producing an activation of circulation of a drilling fluid in the drilling hole around the drilling equipment, wherein the profiled element further includes a deflection area, in an adjacent position between the abutment area and the turbulence area and extending in the axial direction of the profiled element, comprising an external surface, of revolution around the axis of the drilling equipment, that is inclined with respect to the axis of the drilling, with a meridian line in an axial plane that moves away from the axis of the profiled element in a direction proceeding from bottom to top in a service position of the profiled element in the drilling hole.

18. An intermediate coupling comprising at least one profiled element for rotary drilling equipment, having an axis of rotation, for producing a drilling hole defining a wall, the profiled element having an overall shape of revolution and an axis directed along the axis of rotation of the drilling and at least one area of abutment on the wall of the drilling hole extending in the axial direction of the profiled element and having a maximum diameter constituting the maximum diameter of the drilling equipment and a turbulence area for producing an activation of circulation of a drilling fluid in the drilling hole around the drilling equipment, wherein the profiled element further includes a deflection area, in an adjacent position between abutment area and the turbulence area and extending in the axial direction of the profiled element, comprising an external surface, of revolution around the axis of the drilling equipment, that is inclined with respect to the axis of the drilling, with a meridian line in an axial plane that moves away from the axis of the profiled element in a direction proceeding from bottom to top in a service position of the profiled element in the drilling hole.

19. A threaded end coupling of a drill pipe comprising at least one profiled element for rotary drilling equipment, having an axis of rotation, for producing a drilling hole defining a wall, the profiled element having an overall shape of revolution and an axis directed along the axis of rotation of the drilling and at least one area of abutment on the wall of the drilling hole extending in the axial direction of the profiled element and having a maximum diameter constituting the maximum diameter of the drilling equipment and a turbulence area for producing an activation of circulation of a drilling fluid in the drilling hole around the drilling equipment, wherein the profiled element further includes a deflection area, in an adjacent position between the abutment area and the turbulence area and extending in the axial direction of the profiled element, comprising an external surface, of revolution around the axis of the drilling equipment, that is inclined with respect to the axis of the drilling, with a meridian line in an axial plane that moves away from the axis of the profiled element in a direction proceeding from bottom to top in a service position of the profiled element in the drilling hole.

20. A stabiliser for a drill pipe string consisting of a profiled element for rotary drilling equipment, having an axis of rotation, for producing a drilling hole defining a wall, the profiled element having an overall shape of revolution and an axis directed along the axis of rotation of the drilling and at least one area of abutment on the wall of the drilling hole extending in the axial direction of the profiled element and having a maximum diameter constituting the maximum diameter of the drilling equipment and a turbulence area for producing an activation of circulation of a drilling fluid in the drilling hole around the drilling equipment, wherein the profiled element further includes a deflection area, in an adjacent position between the abutment area and the turbulence area and extending in the axial direction of the profiled element, comprising an external surface, of revolution around the axis of the drilling equipment, that is inclined with respect to the axis of the drilling, with a meridian line in an axial plane that moves away from the axis of the profiled element in a direction proceeding from bottom to top in a service position of the profiled element in the drilling hole, the profiled element having abutment areas at which the diameter of the profiled element is at a maximum constitute stabiliser blades, the maximum diameter of the profiled element being slightly less than or substantially equal to the diameter of the drilling hole.

* * * * *